US007360478B2

(12) United States Patent
Compton et al.

(10) Patent No.: US 7,360,478 B2
(45) Date of Patent: Apr. 22, 2008

(54) PROJECTILE LAUNCHER CONVERTIBLE FOR LEFT OR RIGHT HAND OPERATION

(75) Inventors: David Walter Compton, Kitchener (CA); Stephen John Sajkowski, Guelph (CA); Gwyn Morgan, Kitchener (CA)

(73) Assignee: Colt Canada Corporation, Kitchener, Ontario (CA)

( * ) Notice: Subject to any disclaimer, the term of this patent is extended or adjusted under 35 U.S.C. 154(b) by 170 days.

(21) Appl. No.: 11/239,209

(22) Filed: Sep. 30, 2005

(65) Prior Publication Data

US 2007/0074437 A1 Apr. 5, 2007

(51) Int. Cl.
*F41A 9/45* (2006.01)
*F41C 27/06* (2006.01)

(52) U.S. Cl. ..... 89/33.03; 42/27; 42/105

(58) Field of Classification Search ..... 42/27, 42/105; 89/33.03
See application file for complete search history.

(56) References Cited

U.S. PATENT DOCUMENTS 3,557,482 A * 1/1971 Hoover ..... 42/12
3,641,691 A * 2/1972 Ellis et al. ..... 42/105

FOREIGN PATENT DOCUMENTS

GB 2 136 935 A * 9/1983

* cited by examiner

*Primary Examiner*—Stephen M Johnson
(74) *Attorney, Agent, or Firm*—Jeffrey W. Wong; Borden Ladner Gervais LLP

(57) ABSTRACT

A launcher which can be readily converted for use by either a right-handed or left-handed shot. The launcher has a receiver with upper and lower extensions extending forwardly from the receiver body. A barrel is pivotally mounted near forward portions of the extensions, in one of two positions, such that in one position it is pivotable from a home position aligned with the receiver and the extensions between the two extensions, to a load position with the breech of the barrel to the left, and such that in the other position it is pivotable from the home position, to a load position with the breech to the right. One way of accomplishing this is with a barrel support bracket to which the barrel is pivotally mounted, with the barrel support bracket being secured at or near the front of the receiver extensions, and being rotatable between two positions, each corresponding to a different swing direction for the barrel.

5 Claims, 8 Drawing Sheets

PROJECTILE LAUNCHER CONVERTIBLE FOR LEFT OR RIGHT HAND OPERATION

FIELD OF THE INVENTION

This invention relates generally to launchers for grenades, tear gas canisters, etc., hereinafter generally referred to as "projectiles".

More particularly, the invention provides a launcher which is easily convertible for use by either a left-handed or right-handed shot, i.e. for firing from the left shoulder or the right shoulder.

The projectiles are typically 40 mm with an overall length of not greater than 145 mm, and may also include such items as sound and flash ("stun") grenades, parachute flares, smoke grenades, practice grenades, etc. However, the principle of the invention clearly could be readily adapted to other calibers and projectiles than the preceding.

BACKGROUND OF THE INVENTION

Projectile launchers are well known, and can be mounted on a rifle (typically beneath), or operated independently. In either case, it is known to have a barrel which pivots to one side about a generally vertical axis, from a forward pivot point, to expose the breech end of the barrel for manual loading of the projectile. For a person who shoots right-handed, it is typical for the breech end to swing open to the left, for loading of a projectile with the left hand. For a person who shoots left-handed, of course it is preferable for the breech to swing open to the right.

An obvious difficulty with this arrangement is that a launcher configured for use by a right-handed shot is not well-configured for use by someone who is a left-handed shot. Thus it is known to manufacture two versions of any particular launcher, namely a right-handed version and a left-handed version. For obvious reasons, this is an undesirable situation. For one thing, it forces police or military units to stock a larger inventory of launchers than might otherwise be the case. Furthermore, in the field it does not provide a desirable degree of flexibility in terms of who can effectively use any given launcher.

Accordingly, a launcher which could readily be used by either a right or left handed user would offer significant advantages.

SUMMARY OF THE INVENTION

In view of the preceding, it is an object of the invention to provide an improved launcher, which can be readily converted for use by either a right-handed or left-handed shot. In the invention, it is not intended that the conversion would necessarily take place in the field, though possible. It is however intended that at least the conversion can be done readily, though not necessarily from moment to moment in the field.

Thus according to one aspect of the invention, the launcher has a receiver with upper and lower extensions extending forwardly from the receiver body. A barrel is pivotally mounted near forward portions of the extensions, in one of two positions, such that in one position it is pivotable from a home position aligned with the receiver and the extensions between the two extensions, to a load position with the breech of the barrel to the left, and such that in the other position it is pivotable from the home position, to a load position with the breech to the right. (All references to directions herein assume that the launcher is aligned with a vertical plane, pistol grip down, with the barrel horizontal. "Left" and "right" are as viewed from behind the launcher.)

In one aspect of the invention, this is accomplished by providing a generally U-shaped barrel support bracket which is removably secured to the extensions of the receiver. The barrel is pivotally mounted between arms of the U-shape, for pivoting about a generally vertical pivot axis. The open portion of the U-shape is directed laterally to allow the barrel to swing about the pivot axis to expose the breech for loading. The barrel support bracket may be removed, rotated 180 degrees about the longitudinal axis of the receiver, and reinstalled so that the barrel can instead be swung in the opposite direction.

Further aspects and features of the invention will be described or will become apparent in the following detailed description.

BRIEF DESCRIPTION OF THE DRAWINGS

The invention will now be described in greater detail, with reference to the accompanying drawings of the preferred embodiment as a example of the invention.

In the drawings.

DETAILED DESCRIPTION

Figure 1:
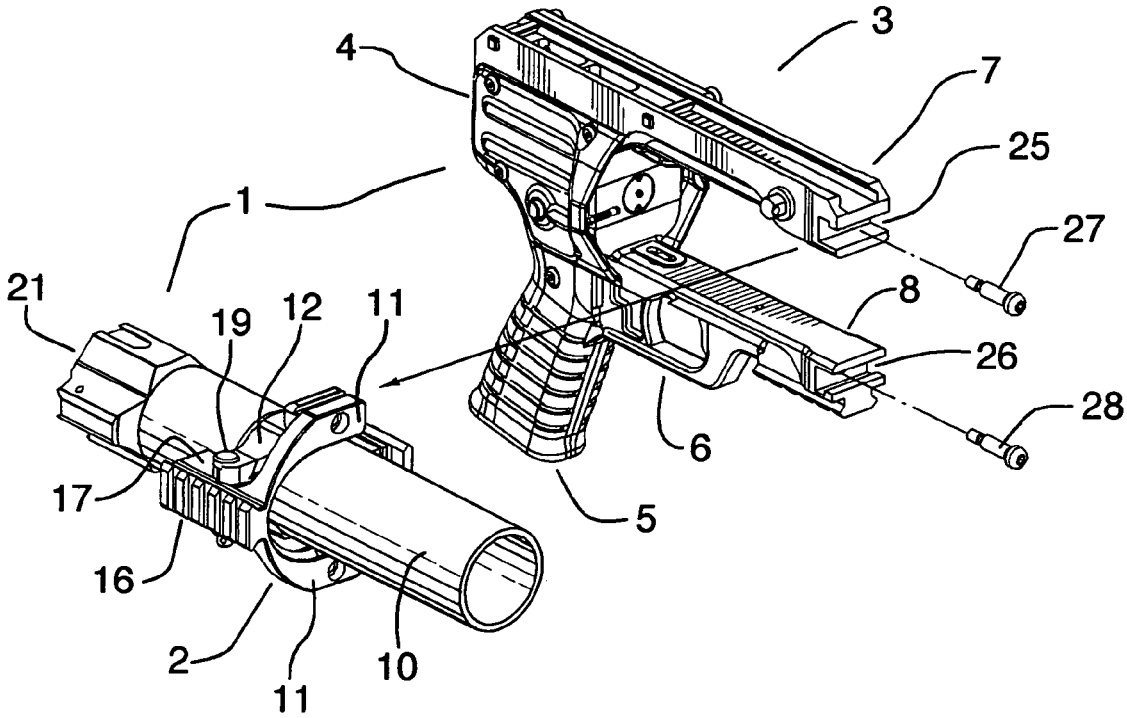
FIG. 1 is an exploded perspective view showing the receiver assembly from the front right, and the barrel assembly slidable into position on the end of the receiver, with the U-shaped opening to the left of the launcher.
Figure 2:
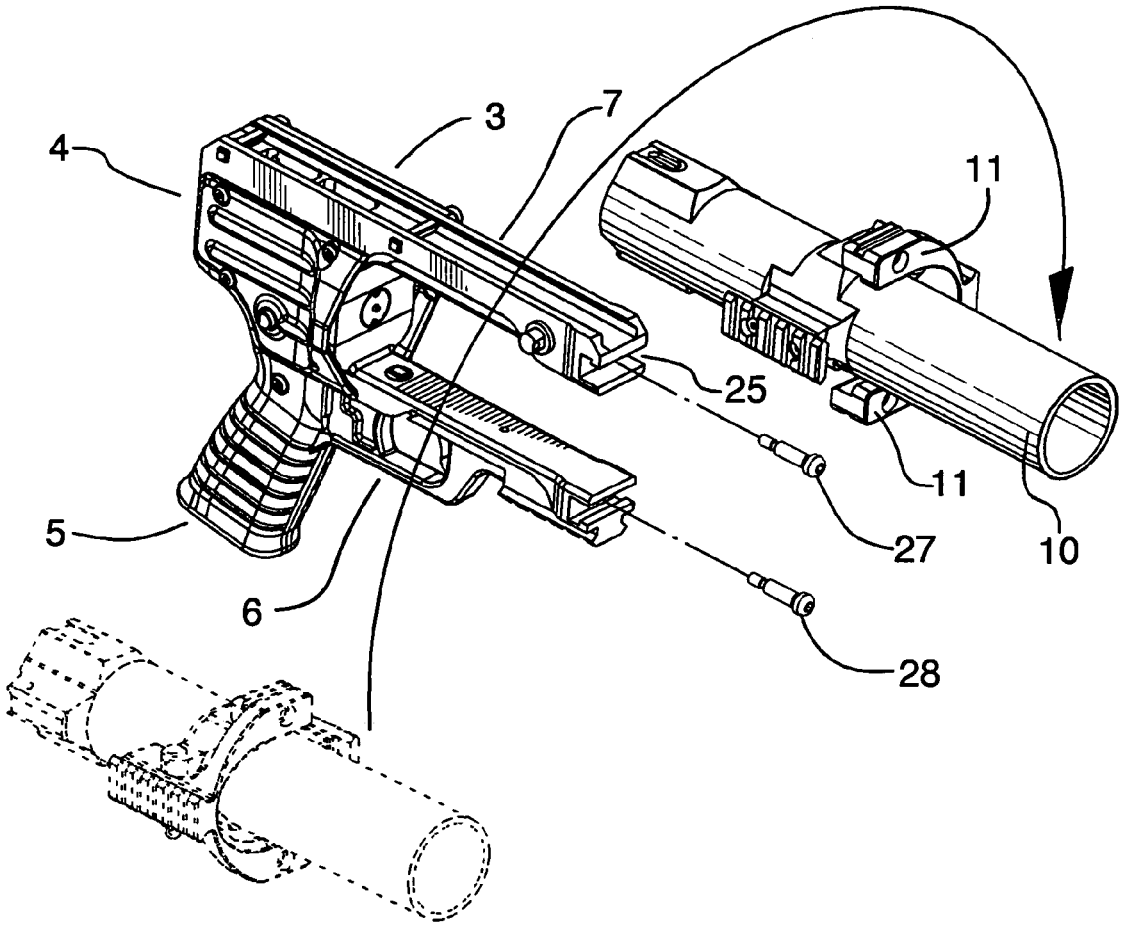
FIG. 2 is a corresponding exploded perspective view, showing the barrel assembly and barrel support bracket rotated 180 degrees, so that the U-shape opens to the right of the launcher.
Figure 3:
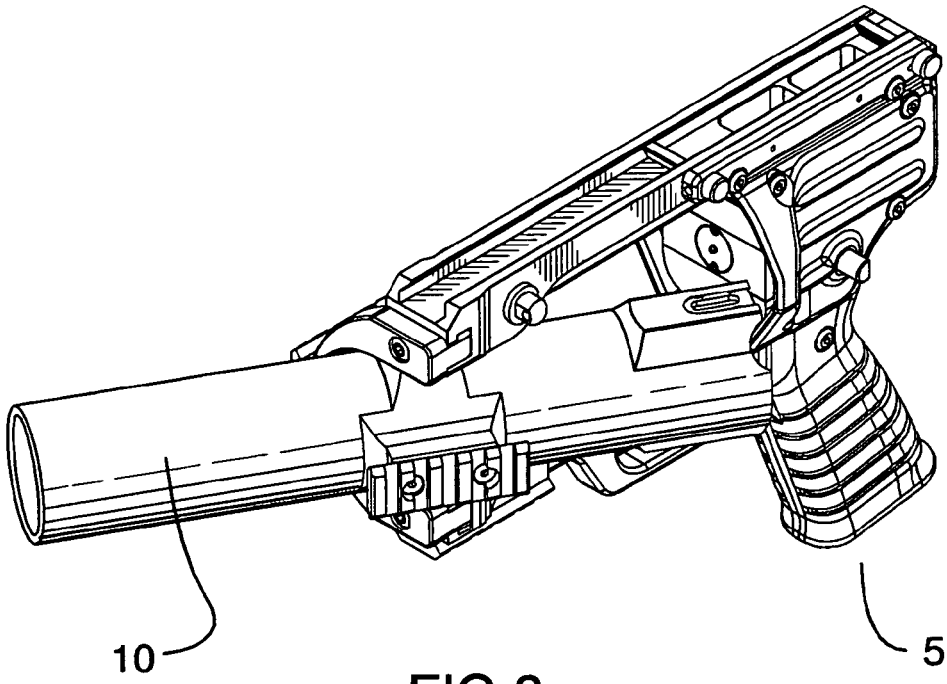
FIG. 3 is a perspective view of the assembled launcher, from the left front of the launcher, with the launcher configured so that the U-shaped opening faces to the left, for the breech to open to the left, as desirable for a right-handed shot.
Figure 4:
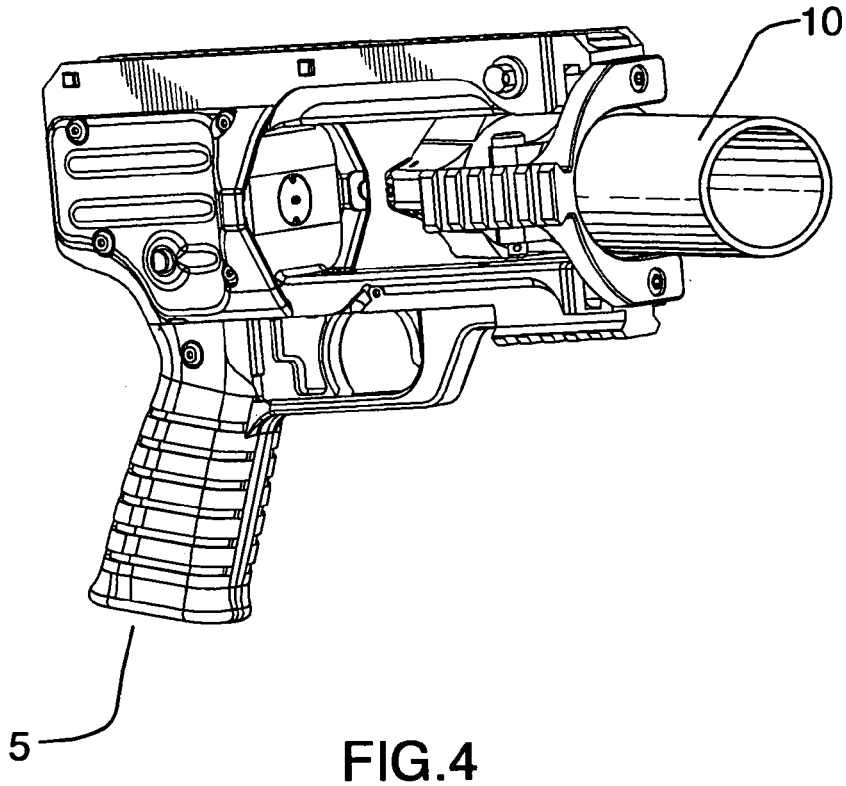
FIG. 4 is a corresponding perspective view from the right front.
Figure 5:
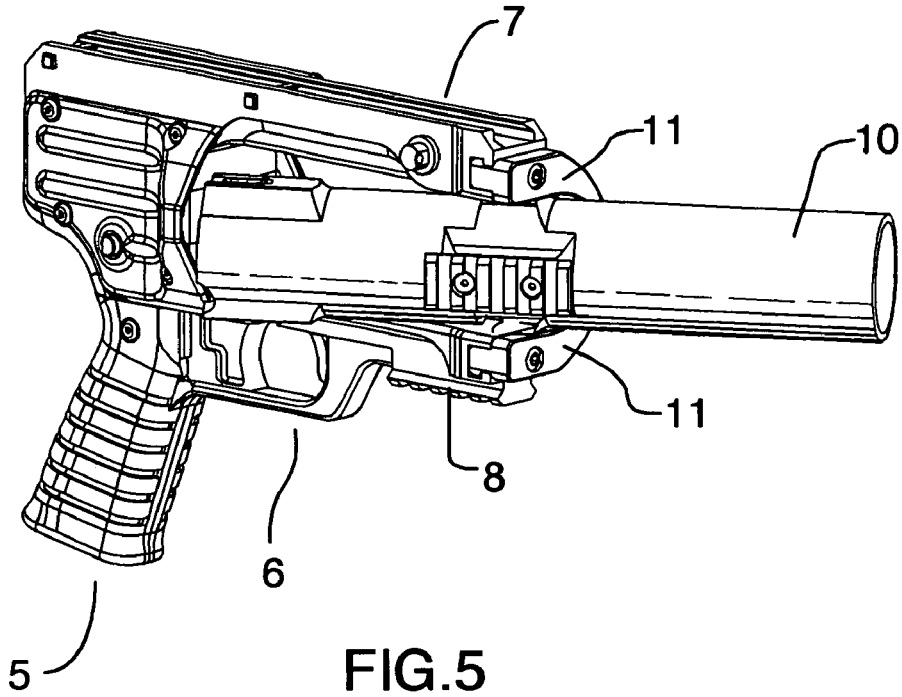
FIG. 5 is a perspective view of the assembled launcher, from the right front of the launcher, with the launcher configured so that the U-shaped opening faces to the right, for the breech to open to the right, as desirable for a left-handed shot.
Figure 6:
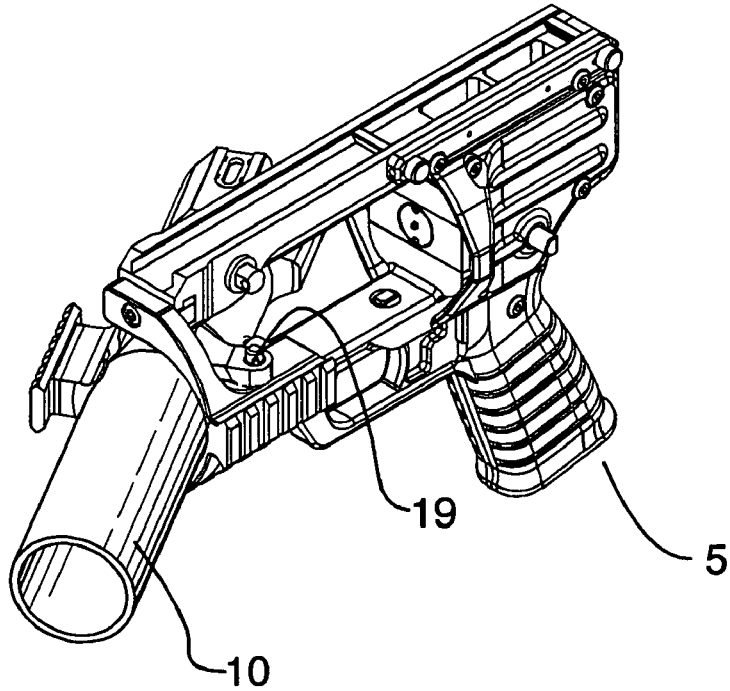
FIG. 6 is a corresponding perspective view from the left front.
Figure 7:
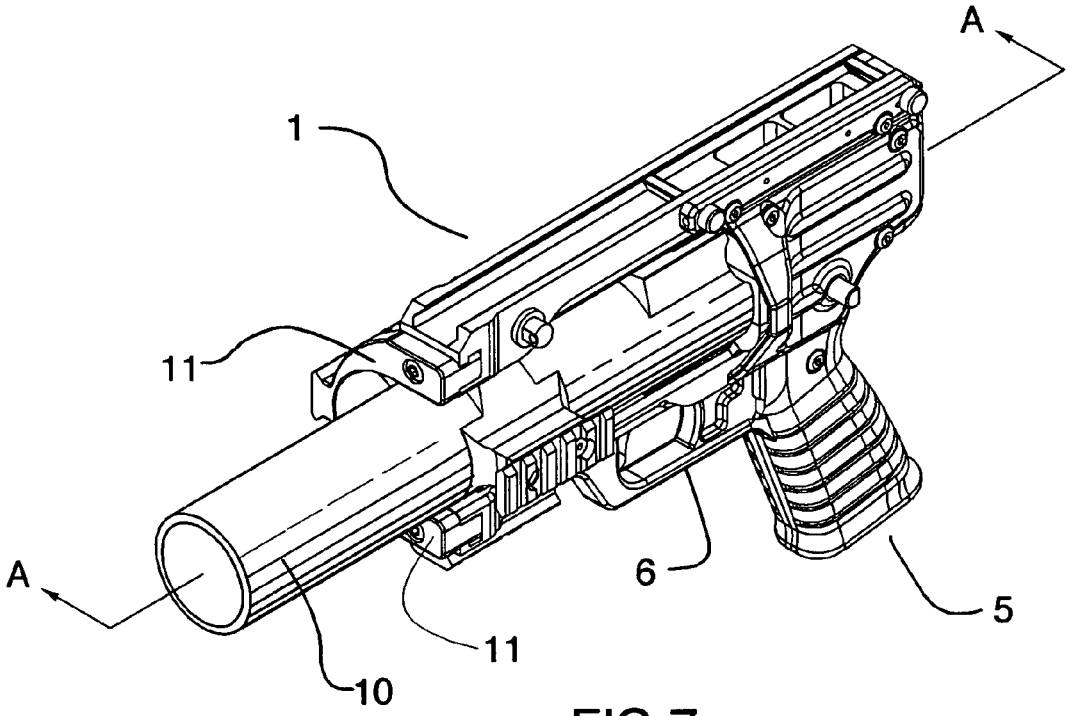
FIG. 7 is a perspective view of the launcher with the barrel in firing position.
Figure 8:
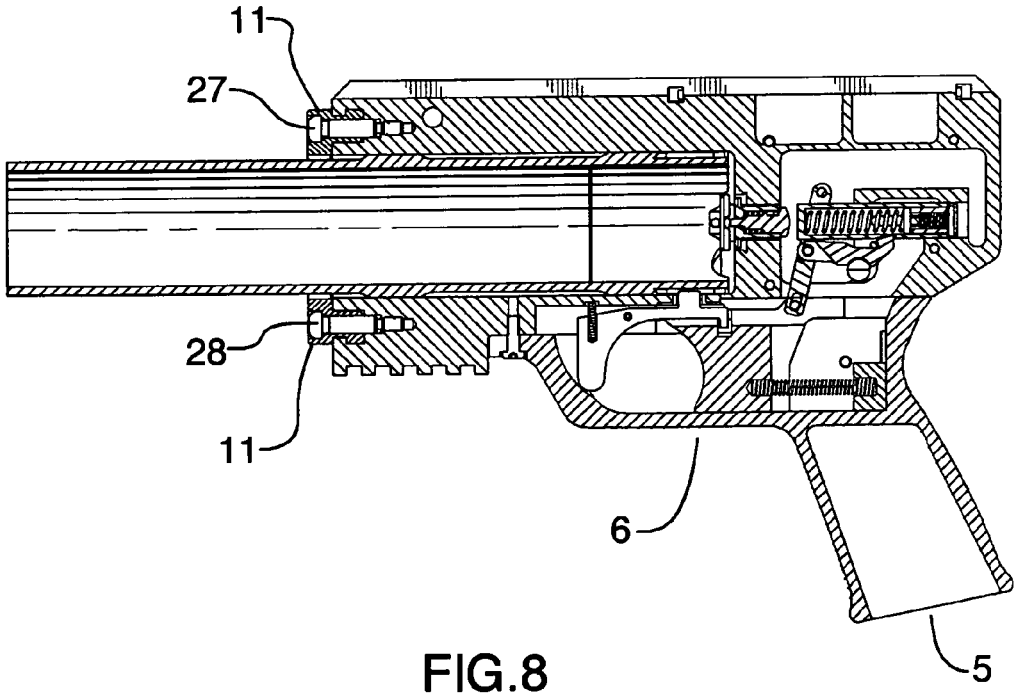
FIG. 8 is a cross-section at A-A of FIG. 7.
Figure 9:
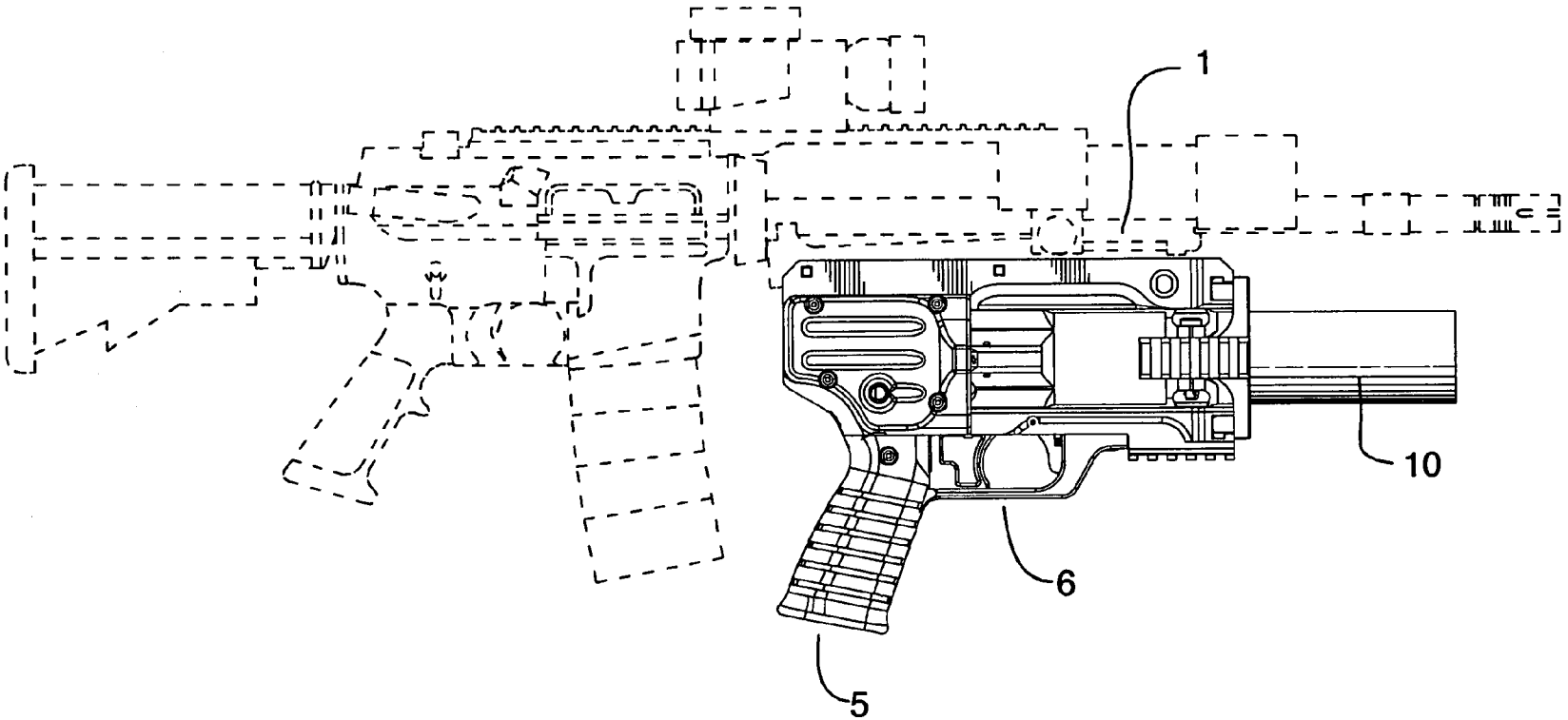
FIG. 9 is a side view of the launcher, showing it mounted beneath a typical rifle.

In the preferred embodiment of the launcher 1, as best seen in FIGS. 1 and 2, a generally U-shaped barrel support bracket 2 is removably secured generally at the front of the receiver assembly 3 of the launcher. The receiver assembly includes, among other components, a receiver body 4, a pistol grip 5, a trigger assembly 6, and upper and lower extensions 7 and 8 respectively. The barrel 10 is pivotally mounted between arms 11 of the barrel support bracket 2, for pivoting about a generally vertical pivot axis.

The barrel support bracket 2 has a laterally protruding flange 12 having a vertical pivot hole. Secured to or preferably integral with the bracket is a rail assembly, including a rail 16 (preferably according to MIL-STD-1913, for example). The rail assembly includes a flange 17 having a vertical pivot hole. A pivot pin 19 is installed in the pivot holes in the flanges 12 and 17, defining a vertical pivot axis for the barrel.

The open portion of the U-shape is directed laterally to allow the barrel to swing about the pivot axis to expose the breech 21 for loading. The barrel support bracket may be removed, rotated 180 degrees about the longitudinal axis of the receiver, and reinstalled so that the barrel can instead be swung in the opposite direction, as can be seen most clearly in FIG. 2.

As can be seen best from FIGS. 1 and 2, the barrel support bracket arms 11 are shaped to mate with upper and lower channels 25 and 26 in the upper and lower extensions 7 and 8, by sliding in from either side. This configuration provides a good deal of structural strength to the front of the launcher, despite the length of the extensions. Upper and lower screws 27 and 28 secure the bracket in position.

Figure 10:
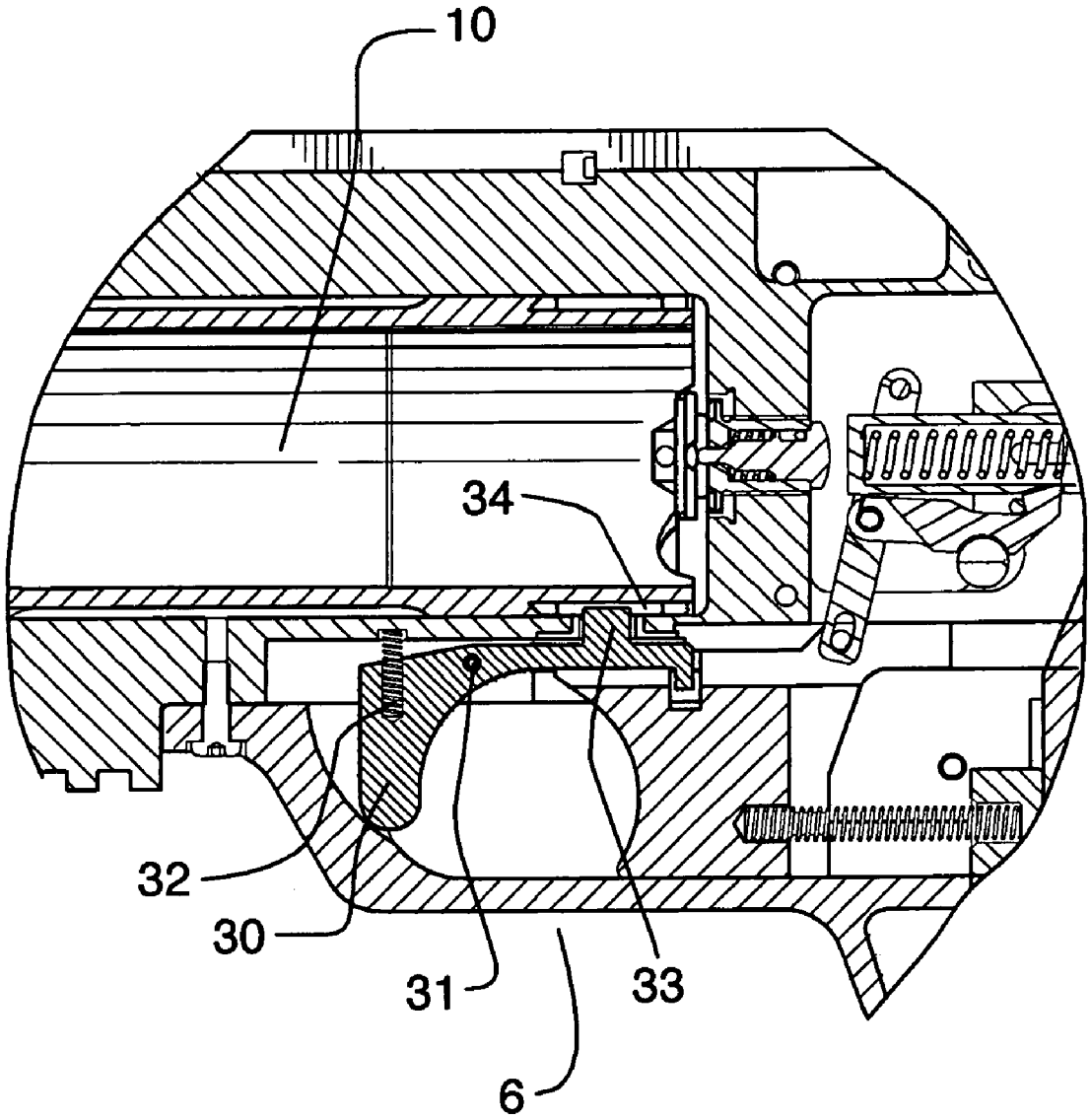
FIG. 10 is a cross-section corresponding to FIG. 8, focusing on the barrel latch.

Of course the launcher is provided with suitable means for locking the barrel in place for firing, and for unlocking it to allow it to be swung laterally to eject the cartridge of a fired projectile and to allow reloading. The locking and unlocking mechanism in the preferred embodiment can be best seen in FIG. 10. A latch assembly 30 rotates about a pivot pin 31, and is biased by a spring 32 to urge a catch 33 into a recess 34 on the underside of the barrel 10. However, any suitable locking mechanism, conventional or otherwise, may be employed as an alternative.

Figure 11:
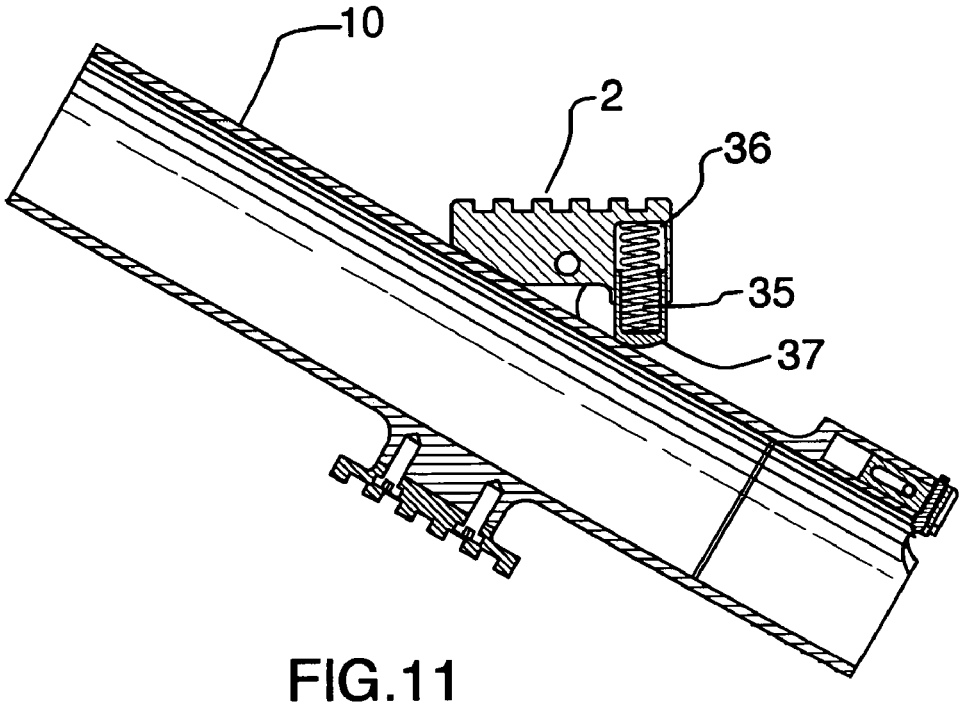
FIG. 11 is a view showing a spring assembly which biases the barrel open when released by the barrel latch.

Pressing the latch forward disengages the catch 33, allowing the barrel to rotate. Preferably, there is spring loading which then springs the barrel open. In the preferred embodiment, that spring loading is provided by a spring 35 located in a pocket 36 in the barrel support bracket 2, as illustrated in FIG. 11. The spring has a bullet-nosed sleeve 37, which bears against the barrel to push it outwardly when the catch 33 releases.

Similarly, of course the launcher is provided with a suitable trigger mechanism and safety, again conventional or otherwise. Again, that is not part of the invention as such; the invention relates strictly to the reversible barrel and the structure which facilitates that.

Among other advantages, it is a specific advantage of the invention that the barrel assembly (i.e. barrel 10, barrel support bracket 2, pivot pin 19, spring 35, etc.) is all one unit, with no field disassembly required. To change the orientation of the launcher, just the two screws 27 and 28 need to be removed, and then the barrel assembly can be removed, rotated and reinstalled very easily.

Within the principle of the invention as defined by the accompanying claims, those knowledgeable in the field of the invention will appreciate that many variations in structure and detail will be feasible without departing from the spirit and scope of the invention. Such variations are considered to be within the scope of the invention as defined by the claims, whether or not expressly recited herein.

Figure 12:
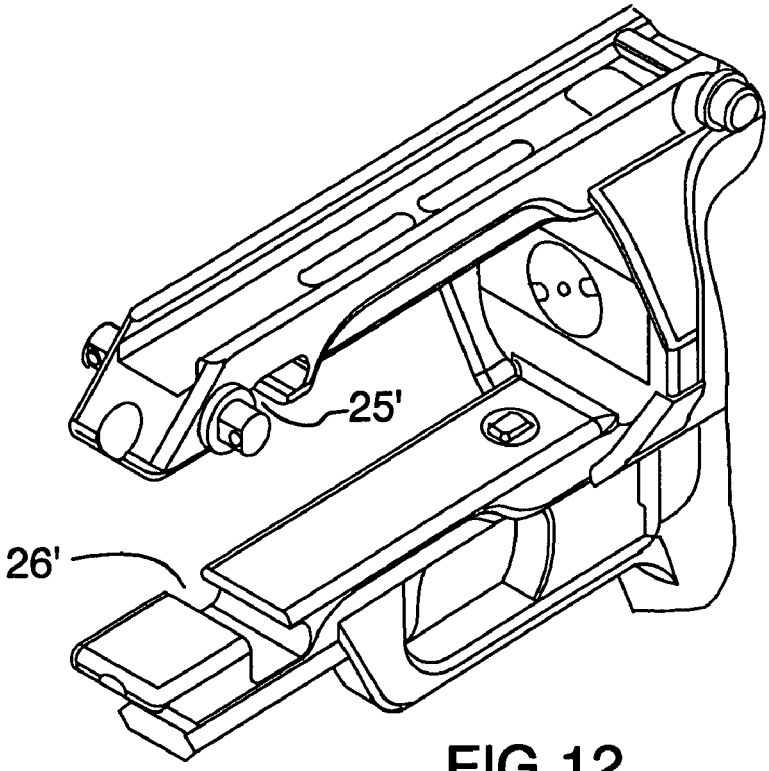
FIG. 12 is a perspective view showing an example of an alternative location for the channels which receive the barrel support bracket.

As a specific non-limiting example, FIG. 12 shows an alternative arrangement for the channels 25' and 26', with the barrel support bracket arms (not shown in this view) having correspondingly shaped flanges to fit within these alternatively-configured channels. Of course many similar variations could be contemplated.

The invention claimed is:

1. A projectile launcher comprising:

a receiver assembly having a receiver body and upper and lower extensions extending forwardly from the receiver body;

a barrel, having a breech at a proximal end thereof, said barrel being pivotally mounted between said upper and lower extensions near forward portions of the extensions, in one of two possible positions, such that in one position said barrel is pivotable from a home position aligned with the receiver and the extensions, to a first load position with the breech of the barrel to one side of the receiver assembly, and such that in the other position said barrel is pivotable from the home position, to an alternative load position with the breech to the other side of the receiver assembly;

wherein said pivotal mounting of said barrel is via pivot points in a generally U-shaped barrel support bracket which is removably secured generally at the front of said receiver assembly with an opening to one of either sides of the launcher, said barrel support bracket being removable from said receiver assembly and rotatable through 180 degrees about a longitudinal axis of the receiver assembly, and reinstallable so that the barrel can instead be pivoted in an opposite lateral direction.

2. A projectile launcher as in claim 1, wherein said barrel support bracket has lateral upper and lower flanges which engage upper and lower lateral channels of said upper and lower extensions respectively.

3. A projectile launcher as in claim 2, wherein said upper and lower flanges have mounting holes therethrough, and screws extending therethrough into said extensions to secure said barrel support bracket once installed with said flanges in said channels.

4. A projectile launcher as in claim 1, further comprising means for locking said barrel in said home position, and for unlocking said barrel to allow pivoting, comprising a latch assembly spring-biased to urge a catch into a recess in said barrel.

5. A projectile launcher as in claim 4, further comprising spring biasing means positioned to urge said barrel to pivot away from said home position when said latch assembly is actuated to disengage said catch.

* * * * *